United States Patent [19]

Larrauri et al.

[11] Patent Number: 4,508,616

[45] Date of Patent: Apr. 2, 1985

[54] HYDROCRACKING WITH TREATED BAUXITE OR LATERITE

[75] Inventors: José M. Larrauri; Beairit C. Arias; Roberto E. Galiasso, all of Los Teques, Venezuela

[73] Assignee: Intevep, S.A., Caracas, Venezuela

[21] Appl. No.: 613,358

[22] Filed: May 23, 1984

Related U.S. Application Data

[60] Division of Ser. No. 525,624, Aug. 23, 1983, Pat. No. 4,465,784, which is a continuation-in-part of Ser. No. 394,840, Jul. 2, 1982, abandoned.

[51] Int. Cl.[3] ..... C10G 47/04

[52] U.S. Cl. ..... 208/111; 208/251 R; 208/213; 208/112

[58] Field of Search ..... 208/111, 251 R, 213

[56] References Cited

U.S. PATENT DOCUMENTS

| | | | |
|---|---|---|---|
| 2,717,855 | 9/1955 | Nicholson | 208/251 H |
| 2,758,060 | 8/1956 | Porter et al. | 208/251 H |
| 2,759,899 | 8/1956 | Hanson | 208/213 |
| 3,716,479 | 2/1973 | Weisz et al. | 208/251 H |
| 4,224,140 | 9/1980 | Fujumori et al. | 208/124 |
| 4,303,497 | 12/1981 | Mitchell et al. | 208/251 R |
| 4,329,221 | 5/1982 | Farcasiu et al. | 208/254 H |
| 4,412,914 | 11/1983 | Hettinger, Jr. et al. | 208/253 |
| 4,465,784 | 8/1984 | Larrauri et al. | 502/242 |

FOREIGN PATENT DOCUMENTS

| | | | |
|---|---|---|---|
| 0537711 | 3/1952 | Canada | 208/251 H |

*Primary Examiner*—Delbert E. Gantz
*Assistant Examiner*—Lance Johnson
*Attorney, Agent, or Firm*—Bachman and LaPointe

[57] ABSTRACT

A catalyst for use in the conversion of heavy hydrocarbons to light ones, the catalyst being prepared from a naturally occurring material characterized by an elemental composition comprising aluminum, iron, silicon, magnesium and titanium by the thermal and chemical treatment of the naturally occurring material with steam/$H_2+H_2S$ so as to change the physical properties and surface chemical properties of the starting material.

2 Claims, No Drawings

HYDROCRACKING WITH TREATED BAUXITE OR LATERITE

CROSS REFERENCE TO RELATED APPLICATIONS

This application is a Divisional of Application Ser. No. 525,624, filed Aug. 23, 1983 now U.S. Pat. No. 4,465,784, which in turn is a Continuation-In-Part of Application Ser. No. 394,840, filed July 2, 1982, now abandoned.

BACKGROUND OF THE INVENTION

The present invention resides in a catalyst characterized by a surface composition of sulphide, oxides and/or hydroxides of aluminum, iron, silicon, magnesium, titanium and nickel for use in the conversion of heavy hydrocarbons to light ones and, more particularly, a method for the preparation of the catalyst from naturally occurring materials by thermal and chemical reaction of same and a process for the treatment of heavy hydrocarbons with the catalyst so produced.

Until now, catalysts of the type set forth above have never been used for converting heavy hydrocarbons containing a high level of metals and asphaltenes into light ones in the presence of hydrogen. The catalyst of the present invention provides a great advantage with respect to conventional ones due to its low cost, its high sensitivity for vanadium removal, and its high stability.

SUMMARY OF THE INVENTION

According to the present invention, a catalyst is provided which contains sulphur, oxides and/or hydroxides of aluminum, iron, silicon, magnesium, titanium and nickel in surface, wherein the aluminum and iron, as metals, are present between 0.1 and 50% by weight of the total catalyst, the silicon and magnesium, as metals, are present between 0.1 and 30% by weight of the total catalyst and the titanium and nickel, as metals, are present between 0.1 and 10% by weight of the total catalyst.

The catalyst composition may also contain sulphur, oxides and/or hydroxides of calcium, potassium, sulphur, zinc, zirconium, gallium, copper, chrome, manganese, cobalt and molybdenum, wherein the metal has a concentration of 1 to 10,000 parts per million by weight of the total catalyst.

The catalyst is activated by means of thermal and chemical treatments at a temperature between 100° and 1,000° C. in the presence of various oxidizing agents followed by a reducing atmosphere of $H_2+H_2S$ for periods of time varying between 1 and 36 hours. The resulting catalyst thus treated has a total surface area varying between 50 and 500 $m^2/g$ and a total porous volume between 0.20 and 0.80 cc/g and special surface chemical composition.

DETAILED DESCRIPTION

In accordance with the hydrocarbon treatment process of the present invention a heavy hydrocarbon with a high metal and asphaltene content is placed in a hydrotreatment zone in contact with the catalyst of the present invention and hydrogen is introduced under controlled conditions so as to produce the greatest possible quantity of light hydrocarbons with no significant production of "pitch".

The hydrocracking catalyst of the present invention has the physical characteristics shown in Table 1. They have a special pore distribution with 30 to 70% of pore volume having a pore radius of greater than 100 Å.

TABLE I

PHYSICAL CHARACTERISTICS OF THE CATALYST

| | Full Range | | Preferred | | More Preferred | |
|---|---|---|---|---|---|---|
| | Min. | Max. | Min. | Max. | Min. | Max. |
| Surface Area, $m^2/g$ | 50 | 500 | 55 | 200 | 60 | 150 |
| Porous Volume, cc/g | 0.20 | 0.60 | 0.22 | 0.50 | 0.30 | 0.43 |
| Mean Pore Radius, Å | 20 | 200 | 30 | 150 | 35 | 145 |
| Distribution of Porous Volume | | | | | | |
| PV with R 10 Å, % | 0 | 100 | 1 | 80 | 1 | 50 |
| PV with 10 ÅR 100 Å, % | 0 | 100 | 5 | 50 | 10 | 45 |
| PV with R 100 Å, % | 0 | 100 | 5 | 80 | 30 | 70 |

The catalyst consists of one or more oxides and/or hydroxides of aluminum on the surface, wherein the aluminum is present in at least 0.1% by weight (as metal) of the total catalyst, preferably between 0.5% and 50% by weight of the total catalyst, and more preferably between 1 and 30% by weight of the total catalyst.

It also has one or more sulphides, oxides and/or hydroxides of iron on catalyst surface wherein the iron is present in at least 1% by weight (as metal) of the total catalyst, preferably between 3 and 50% by weight of the total catalyst, and more preferably between 5 and 48% by weight of the total catalyst.

It also contains one or more oxides and/or hydroxides of silicon on catalyst surface wherein the silicon is present in at least 0.1% by weight (as metal) of the total catalyst, preferably between 1 and 30% by weight of the total catalyst, and more preferably between 5 and 20% by weight of the total catalyst.

The catalyst likewise possesses one or more oxides and/or hydroxides of magnesium on the surface, wherein the magnesium is present in at least 0.1% by weight (as metal) of the total catalyst, preferably between 0.1 and 30% by weight of the total catalyst, and more preferably between 0.1 and 20% by weight of the total catalyst.

The catalyst also contains sulphides and/or oxides of nickel and titanium on surface wherein the nickel and titanium are present in at least 0.1% by weight (as metal) of the total catalyst, preferably between 1 and 10% by weight of the total catalyst, and more preferably between 2 and 5% by weight of the total catalyst.

Other metals which may be present include calcium, potassium, sulphur, zinc, zirconium, gallium, copper, chrome, manganese, cobalt and molybdenum, generally found in a concentration between 1 to 10,000 parts per million by weight of the catalyst.

All of the above metals are present in the natural occurring material with the exception of sulphur which is added during chemical treatment.

The catalyst is prepared by the chemical treatment of a natural occurring material such as bauxite, laterite iron mineral, laterite nickel mineral or the like having the appropriate elemental composition. The mineral is treated first in air+steam at 300°-900° C., preferably at 500°-800° C. for 1 to 36 hours, preferably for 12 to 24 hours. The partial pressure of steam used is varied from 20-700 mmHg. Then the sample is treated in $H_2+H_2S$ steam at 200°-500° C., preferably at 250°-450° C. for 1 to 12 hours, preferably for 3 to 5 hours; the pressure of $H_2S$ is varied from 20 to 450 mmHg. Total pressure used is 760 mmHg.

The foregoing treatment changes the physical properties of the starting material such as pore volume, pore volume distribution and surface area. It also changes the surface chemical properties of the material.

The final catalyst contains between 3 and 40% sulphur, preferably between 8 and 30%.

The following examples are presented to illustrate the invention.

EXAMPLE 1

An experiment was carried out using the BU catalyst, prepared from a natural bauxite mineral from Upata in the Bolivar State of Venezuela and treated in accordance with the present invention. The activation method and chemical treatment was as follows: Temperature: 600° C., with steam for 7 hours ($P_{H2O}$: 330 mmHg) followed by treatment with $H_2+H_2S$ at 250° C. for 2 hours. ($P_{H2S}$: 350 mmHg). The characteristics of this BU catalyst are shown in Table 2.

TABLE 2

| BU CATALYST | Actual | Range |
|---|---|---|
| Composition of the Catalyst: | | |
| % Al | 23.40 | 18.5–34.3 |
| % Fe | 16.22 | 3.3–23.1 |
| % Si | 2.53 | 0.3–10.5 |
| % Ti | 1.52 | 0.5–2.0 |
| % S | 12.01 | 8.4–17.3 |
| Physical Properties: | | |
| Surface Area BET, $m^2/g$ | 135 | |
| Total Porous Volume, cc/g | 0.36 | |
| Distribution of Pore Size: | | |
| Mean Pore Radius, Å | 53 | |
| Distribution of Porous Volume: | | |
| PV with R 10 Å, % | 1 | |
| PV with 10 Å R 100 Å, % | 43 | |
| PV with R 100 Å, % | 46 | |

In Table 2, the "Range" column indicates most useful variations within the composition of the BU catalyst.

The catalyst was placed in contact with a heavy hydrocarbon feedstock, (JOBO), the characteristics of which appear in Table 3.

TABLE 3

| PROPERTIES OF THE FEEDSTOCK (JOBO) | |
|---|---|
| Specific Gravity 60/60° F. | 0.986 |
| API Gravity | 12 |
| Sulphur, % by weight | 2.70 |
| Vanadium, ppm | 332 |
| Nickel, ppm | 86 |
| Conradson Carbon, % by weight | 11.77 |
| Asphaltenes, % by weight | 8.71–9.27 |
| Water, % by weight | 1.2 |
| Salts, ppm | 104 |
| Carbon, % by weight | 83.82 |
| Hydrogen, % by weight | 10.89 |
| Nitrogen, % by weight | 0.57 |
| TBP Distillation, % by volume | T in °C. |
| Initial Boiling Point | 77 |
| Residue (72.5) | 400+ |

The conditions for the treatment of the feedstock were: flow rate of the feedstock of 0.1 barrels per day with a flow of hydrogen of 455 lts per hour, in contact 0.5 kg of the catalyst under a temperature of 400° C. and a pressure of 105 bars.

The results of the product obtained from this experiment with the BU catalyst appear in Table 4.

TABLE 4

| TBP Distillation, % by Volume | T in °C. |
|---|---|
| Initial Boiling Point | 29 |
| 5 | 57 |
| 10 | 113 |
| 20 | 232 |
| 30 | 338 |
| 40 | 400 |
| Residue (60) | 400+ |

Sulphur: 2.30% by weight,
Vanadium: 285 ppm,
Asphaltenes: 7.61%.

EXAMPLE 2

A similar experiment was carried out using the LF catalyst, prepared from a natural laterite iron mineral from the region of Los Guaicas in the Bolivar State of Venezuela, and treated in accordance with the present invention. The treatment and activation method were as follows. Temperature: 800° C., with steam for 24 hours ($P_{H2O}$: 330 mmHg) followed by treatment with $H_2+H_2S$ at 300° C. for 4 hours. ($P_{H2S}$: 350 mmHg). The characteristics of this LF catalyst are given in Table 5.

TABLE 5

| LF CATALYST | Actual | Range |
|---|---|---|
| Composition of the Catalyst: | | |
| % Al | 20.00 | 12.3–30.0 |
| % Fe | 40.73 | 24.7–48.4 |
| % Si | 1.92 | 0.8–2.3 |
| % Ti | 3.03 | 2.0–4.8 |
| % S | 13.04 | 10.0–25.1 |
| Physical Properties: | | |
| Surface Area BET, $m^2/g$ | 48 | |
| Total Porous Volume, cc/g | 0.34 | |
| Distribution of Pore Size: | | |
| Mean Pore Radius, Å | 142 | |
| Distribution of Porous Volume: | | |
| PV with R 10 Å, % | 40 | |
| PV with 10 Å R 100 Å, % | 14 | |
| PV with R 100 Å, % | 46 | |

In Table 5, the "Range" column indicates most useful variations within the composition of the LF catalyst.

The catalyst was placed in contact with a heavy hydrocarbon feedstock, (JOBO), with the same characteristics as used in Example 1 and which appear in Table 3. The treatment conditions used were the same as in Example 1, except for the temperature which was 410° C. The results of the product obtained from this experiment with the LF catalyst appear in Table 6.

TABLE 6

| TBP Distillation, % by Volume | T in °C. |
|---|---|
| Initial Boiling Point | 104 |
| 5 | 171 |
| 10 | 221 |
| 20 | 288 |
| 30 | 329 |
| 40 | 368 |
| 50 | 400 |
| Residue (50) | 400+ |

Sulphur: 2.14% by weight,
Vanadium: 200 ppm,
Asphaltenes: 6.82%

EXAMPLE 3

A similar experiment was carried out using the LN catalyst, prepared from a natural laterite nickel mineral from the region of Loma de Hierro in the Aragua State of Venezuela, and treated in accordance with the present invention. The treatment and activation method were as follows. Temperature: 500° C., with steam for 24 hours ($P_{H2O}$: 330 mmHg) followed by treatment with $H_2+H_2S$ at 300° C. for 4 hours. ($P_{H2S}$: 350 mmHg). The characteristics of the LN catalyst can be seen in Table 7.

TABLE 7

| LN CATALYST | Actual | Range |
|---|---|---|
| Composition of the Catalyst: | | |
| % Al | 0.39 | 0.2–3.4 |
| % Fe | 7.26 | 6.8–60.4 |
| % Si | 19.46 | 2.5–19.5 |
| % Mg | 18.88 | 2.0–18.9 |
| % Ni | 2.78 | 0.7–3.6 |
| % S | 10.45 | 7.4–28.6 |
| Physical Properties: | | |
| Surface Area BET, $m^2/g$ | 128 | |
| Total Porous Volume, cc/g | 0.37 | |
| Distribution of Pore Size: | | |
| Mean Pore Radius, Å | 38 | |
| Distribution of Porous Volume: | | |
| PV with R 10 Å, % | 26 | |
| PV with 10 Å R 100 Å, % | 23 | |
| PV with R 100 Å, % | 41 | |

In Table 7, the "Range" column indicates most useful variations within the composition of the LN catalyst.

The catalyst was placed in contact with a heavy hydrocarbon feedstock, (JOBO), with the same characteristics as used in Examples 1 and 2, and which appear in Table 3.

The results of this experiment with the LN catalyst, and under the same conditions as in Example 1 except for the pressure, which was 120 bars, appear in Table 8.

TABLE 8

| TBP Distillation, % by Volume | T in °C. |
|---|---|
| Initial Boiling Point | 43 |
| 5 | 132 |
| 10 | 191 |
| 20 | 277 |
| 30 | 346 |
| 40 | 400 |
| Residue (60) | 400+ |

Sulphur: 2.08% by weight,
Vanadium: 195 ppm,
Asphaltenes: 5.59%.

As stated hereinabove, the above catalysts used according to this invention are prepared from natural material having the required elemental composition.

EXAMPLE 4

In order to prove the effect of chemical treatment the previously described materials (BU, LF and LN samples) were treated with steam alone and with steam and $H_2+H_2S$ atmosphere. In Table 9 the chemical composition, physical properties, activation method and the activity results are presented for the three catalysts claimed.

TABLE 9

| | EFFECT OF CHEMICAL ACTIVATION | | | | | |
|---|---|---|---|---|---|---|
| | LF Treated With Steam | LF Treated With Steam/ $H_2 + H_2S$ | LN Treated With Steam | LN Treated With Steam/ $H_2 + H_2S$ | BU Treated With Steam | BU Treated With Steam/ $H_2 + H_2S$ |
| (A) Chemical Composition | | | | | | |
| % Fe | 40.07 | 40.07 | 13.84 | 13.84 | 20 | 20 |
| % Al | 20.32 | 20.32 | 0.59 | 0.59 | 45 | 45 |
| % Si | 0.80 | 0.80 | 15.04 | 15.04 | 5 | 5 |
| % Ti | 3.44 | 3.44 | — | — | 1 | 1 |
| % Mg | — | — | 16.69 | 16.69 | — | — |
| % Ni | — | — | 1.47 | 1.47 | — | — |
| % S | — | 18.03 | — | 6.08 | — | 13.5 |
| (B) Physical Properties | | | | | | |
| Area ($m^2/g$) | 46 | 31 | 94 | 58 | 135 | 103.5 |
| VP ($cm^3/g$) | 0.30 | 0.25 | 0.56 | 0.56 | 0.36 | 0.35 |
| Average Pore Radius (Å) | 131 | 166 | 119 | 138 | 53 | 70 |
| Pore Distribution, (% V) Pore Radius (Å) | | | | | | |
| 15–30 | 4.29 | 4.25 | 2.86 | 2.90 | 7.5 | 1.5 |
| 30–45 | 2.86 | 2.70 | 1.43 | 1.40 | 9.50 | 4.5 |
| 45–75 | 4.29 | 4.31 | 1.43 | 1.35 | 19.10 | 22.25 |
| 75–150 | 5.71 | 5.60 | 5.71 | 6.04 | 23.10 | 28.75 |
| 150–500 | 5.71 | 6.01 | 12.85 | 12.44 | 20.00 | 15.30 |
| 500 | 77.14 | 77.13 | 75.71 | 75.87 | 20.00 | 27.7 |
| Partice Size (mm) | 0.1–0.5 | 0.1–0.5 | 0.1–0.5 | 0.1–0.5 | 0.1–0.5 | 0.1–0.5 |
| (C) Activation Method | Steam 800° C. - during 2h ($P_{H2O}$: 200 mmHg) | Steam 800° C. 2h followed by $H_2 + H_2S$ 400° C. ($P_{H2S}$: 70 mmHg) during 4h | Steam 500° C. during 3h ($P_{H2O}$: 300 mmHg) | Steam 500° C. 3h followed by $H_2 + H_2S$ ($P_{H2S}$: 70 mmHg) during 4h | Steam 500° C. 4h ($P_{H2O}$: 200 mmHg) | Steam 500° C. 4h followed by $H_2 + H_2S$ ($P_{H2S}$: 100 mmHg) during 4h |
| (D) Activity* | | | | | | |
| TBP (Distillation) | T(°C.) | T(°C.) | T(°C.) | T(°C.) | T(°C.) | T(°C.) |

TABLE 9-continued

| | EFFECT OF CHEMICAL ACTIVATION | | | | | |
|---|---|---|---|---|---|---|
| | LF Treated With Steam | LF Treated With Steam/ $H_2 + H_2S$ | LN Treated With Steam | LN Treated With Steam/ $H_2 + H_2S$ | BU Treated With Steam | BU Treated With Steam/ $H_2 + H_2S$ |
| (% V) | | | | | | |
| IBP | 104 | 84 | 43 | 40 | 110 | 50 |
| 5 | 171 | 150 | 132 | 120 | 181 | 130 |
| 10 | 221 | 200 | 191 | 165 | 200 | 180 |
| 20 | 288 | 260 | 277 | 240 | 270 | 250 |
| 30 | 329 | 301 | 346 | 305 | 315 | 315 |
| 40 | 368 | 340 | 375 | 335 | 350 | 345 |
| 50 | 400 | 360 | 410 | 350 | 410 | 360 |
| Residue (50) | 400+ | 360+ | 410+ | 350+ | 410+ | 360+ |
| Sulphur (%) w | 2.14 | 2.01 | 2.08 | 1.84 | 2.25 | 1.95 |
| Vanadium (ppm) | 200 | 150 | 195 | 138 | 215 | 145 |
| Asphaltene (%) | 6.82 | 5.10 | 5.59 | 5.04 | 6.92 | 5.1 |
| Gravity °API | 15.7 | 17.0 | 16.1 | 17.5 | 14.7 | 17.0 |

*Reactor Conditions: T = 410° C.; P = 120 bars; 0.1 b/D; 0.5 kg of cat; $H_2$ flow 455 lt/h; Jobo Crude Oil.

It can be seen that the chemical activation modified the pore size distribution, the surface area and the sulphur content. The activity of the samples are improved after the chemical treatment. Sulphur, vanadium and residue conversion were increased by the activation method used.

EXAMPLE 5

In order to prove the change in surface chemical composition by the activation method, analysis of the surface composition was performed by XPS (X-Ray photoelectron spectroscopy). The apparatus used was an AEI-ES200B using a cathode of aluminum (h=1486'6 eV=300 V). The aluminum, iron, titanium, oxygen, sulphur, coal, silicon, intensity pics was recorded and the ratio intensities of metals other than aluminum to the aluminum were taken as a measure of surface concentration. In Table 10 the results for one BU sample activated by air treatment as was claimed in the previous art, and results of other BU samples treated with the present method (steam/$H_2+H_2S$) are presented.

TABLE 10

| | SURFACE CHEMICAL COMPOSITION (XPS) | | | |
|---|---|---|---|---|
| | BU (Air) | | BU Steam ($H_2 + H_2S$) | |
| Elememt | BULK | SURFACE* | BULK | SURFACE* |
| Fe/Al | 0.44 | 0.55 | 0.40 | 0.09 |
| Ti/Al | 0.023 | 0.005 | 0.015 | 0.015 |
| Si/Al | 0.11 | 0.011 | 0.05 | 0.030 |
| O/Al | 0.50 | 0.90 | 0.31 | 0.67 |
| S/Al | — | — | 0.22 | 0.19 |

Fe°(2p): 711/724; Ti°(2p): 458.5/463.2; Si°(2p): 103.4; Al°(2p): 74.6;
Fe°°(2p): 707/712; Ti°°(2p): 458.5/463.2; Si°°(2p): 103.4; Al°°(2p): 74.6;
O(2p): 510/511; S°°(2p): 161;
O°°(2p): 510/511;

It can be seen that the sample chemically activated present a different composition than the other activated by air. This unexpected change in composition are produced by metal migration during chemical treatment to the bulk or from the bulk of the catalyst. Since the relative species present in surface are changed, the modification is hopefully reasonable of the activity improvement.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the hydrocracking and hydrodemetallization of a heavy hydrocarbon feedstock containing a high level of metals and asphaltenes comprising providing a catalyst prepared from a natural occurring material characterized by an elemental composition comprising aluminum, iron, silicon, magnesium and titanium by the thermal and chemical treatment of said natural occurring material with air and steam at a temperature within 300° to 900° C. and a subsequent treatment with $H_2+H_2S$ at a temperature within 200° to 500° C., said catalyst having the following physical properties:

| | |
|---|---|
| Surface Area, $m^2g$ | 50 to 500 |
| Porous Volume cc/g | 0.20 to 0.60 |
| Mean Pore Radius, Å | 20 to 200 |

Porous Volume Distribution:

| | |
|---|---|
| PV with R 10 Å, % | 0 to 100 |
| PV with 10 Å R 100 Å, % | 0 to 100 |
| PV with R 100 Å, % | 0 to 100 |

and a surface chemical composition of from about
0.1 to 50 wt.% Al
1 to 50 wt.% Fe
0.1 to 30 wt.% Si
0.1 to 30 wt.% Mg
0.1 to 10 wt.% Ti
3 to 40 wt.% S
and contacting said heavy hydrocarbon feedstock in the presence of hydrogen with said catalyst in a hydrotreatment zone so as to convert said heavy hydrocarbon feedstock into the greatest possible quantity of light hydrocarbons without a significant production of pitch.

2. A process according to claim 1 including holding said feedstock and said hydrogen in said hydrotreatment zone at a temperature of from about 400° to 410° C. at a pressure of from about 105 to 120 bars.

* * * * *